US010026567B2

(12) United States Patent
Ahn et al.

(10) Patent No.: US 10,026,567 B2
(45) Date of Patent: Jul. 17, 2018

(54) SPRING OPERATION DEVICE OF CIRCUIT BREAKER

(71) Applicant: Hyundai Heavy Industries Co., Ltd., Ulsan (KR)

(72) Inventors: Il Chul Ahn, Ulsan (KR); Kyu Bok Choi, Ulsan (KR); Young Sung Kim, Ulsan (KR); Zoltán Bajnay, Ulsan (KR); Balázs Lévai, Ulsan (KR); Csanád Bakos, Ulsan (KR)

(73) Assignee: Hyundai Electric & Energy Systems Co., Ltd., Seoul (KR)

( * ) Notice: Subject to any disclaimer, the term of this patent is extended or adjusted under 35 U.S.C. 154(b) by 51 days.

(21) Appl. No.: 15/245,871

(22) Filed: Aug. 24, 2016

(65) Prior Publication Data

US 2017/0207038 A1 Jul. 20, 2017

(30) Foreign Application Priority Data

Jan. 14, 2016 (KR) ..... 10-2016-0004704

(51) Int. Cl.
*H01H 3/38* (2006.01)
*H01H 3/30* (2006.01)

(52) U.S. Cl.
CPC ..... *H01H 3/38* (2013.01); *H01H 3/3015* (2013.01); *H01H 3/3026* (2013.01); *H01H 2003/3063* (2013.01)

(58) Field of Classification Search
CPC .... H01H 3/3015; H01H 3/3031; H01H 33/40; H01H 3/3005; H01H 3/42;
(Continued)

(56) References Cited

U.S. PATENT DOCUMENTS 3,875,360 A * 4/1975 Rys ..... H01H 3/30 200/400
2011/0147183 A1 6/2011 Soininen et al.

FOREIGN PATENT DOCUMENTS

EP 0186171 A2 7/1986
EP 2204827 A2 7/2010
(Continued)

OTHER PUBLICATIONS

European Search Report for European Patent Application No. 16186701, dated Jul. 5, 2017, 7 pages.

*Primary Examiner* — Ahmed Saeed
(74) *Attorney, Agent, or Firm* — Mintz Levin Cohn Ferris Glovsky and Popeo, P.C.; Peter F. Corless

(57) ABSTRACT

A spring operation device includes a closing shaft rotating to apply closing driving force to a movable contactor of a circuit breaker; a breaking shaft connected to the closing shaft in an axial direction and rotating to apply breaking driving force to the movable contactor of a circuit breaker; a plurality of springs having one ends connected to the closing shaft and the breaking shaft and the other ends fixed in position and provided along circumferences of the closing shaft and the breaking shaft in order to transmit elastic restoring force to the closing shaft and the breaking shaft to rotate the closing shaft and the breaking shaft; and a power transmission unit connecting the closing shaft and the breaking shaft when a closing operation is performed and releasing a connection between the closing shaft and the breaking shaft when a breaking operation is performed.

18 Claims, 12 Drawing Sheets

(58) Field of Classification Search
CPC ..... H01H 2003/3063; H01H 3/30; H01H 3/3026; H01H 3/3042; H01H 3/3052; H01H 3/46
USPC ..... 200/400, 401, 17 R, 501
See application file for complete search history.

(56) References Cited

FOREIGN PATENT DOCUMENTS

| | | | |
|---|---|---|---|
| JP | 2014-216073 | A | 11/2014 |
| KR | 1020040034227 | | 4/2004 |
| KR | 10-0692265 | B1 | 3/2007 |
| KR | 101132909000 | | 4/2012 |
| KR | 2013-0072147 | | 5/2014 |
| KR | 1020140086651 | | 7/2014 |

* cited by examiner

SPRING OPERATION DEVICE OF CIRCUIT BREAKER

CROSS-REFERENCE TO RELATED APPLICATION

This application claims benefit of priority to Korean Patent Application No. 10-2016-0004704 filed on Jan. 14, 2016 in the Korean Intellectual Property Office, the disclosure of which is incorporated herein by reference in its entirety.

BACKGROUND

1. Field

The present disclosure relates to a spring operation device of a circuit breaker, and more particularly, to a spring operation device of a circuit breaker for actuating a movable contactor using elastic restoring force of a spring.

2. Description of Related Art

A circuit breaker is a device for breaking the flow of electricity in an electric power system when a fault current occurs in the electric power system. Here, the circuit breaker is required to promptly interrupt power flowing in the electric power system by actuating the movable contactor when an abnormal situation occurs.

In order to perform a closing operation and a breaking operation of the circuit breaker, a spring operation device actuating a movable contactor using elastic restoring force of a spring is used.

The spring operation device includes a closing spring applying closing driving power to a movable contactor and a breaking spring applying breaking driving power to the movable contactor.

However, in the related art spring operation device, the closing spring and the breaking spring are implemented as a single spring, and thus, in order to obtain elastic restoring force great enough to actuate the movable contactor, a voluminous spring able to store a large amount of energy is used as the single spring. Also, in order to secure a high degree of elastic restoring force and durability, a hot wound coil spring formed of a relatively high-priced material is used as the single spring.

Thus, the related art spring operation device is disadvantageous in that manufacturing costs thereof are high, there is a limitation in reducing a volume of a device, and there is a limitation in disposing a component, due to the inclusion of a single hot wound coil spring.

In addition, in the related art spring operation device, a closing side and a breaking side are configured as mutually separated shafts, and a mechanism enabling the closing side shaft and the breaking side shaft to interwork with each other includes components such as a plurality of links, cams, and levers, leading to an increase in the volume of the device.

The aforementioned spring operation device using a single spring is disclosed in Korean Patent Laid-Open Publication No. 2013-0072147 and Korean Patent Registration No. 1132909.

SUMMARY

An aspect of the present disclosure may provide a spring operation device of a circuit breaker, incurring low manufacturing costs and reducing a volume of a device.

According to an aspect of the present disclosure, a spring operation device may include: a closing shaft rotating to apply closing driving force to a movable contactor of a circuit breaker; a breaking shaft connected to the closing shaft in an axial direction and rotating to apply breaking driving force to the movable contactor of a circuit breaker; a plurality of springs having one ends connected to the closing shaft and the breaking shaft and the other ends fixed in position and provided along circumferences of the closing shaft and the breaking shaft in order to transmit elastic restoring force to the closing shaft and the breaking shaft to rotate the closing shaft and the breaking shaft; and a power transmission unit provided in a location in which the closing shaft and the breaking shaft are connected, connecting the closing shaft and the breaking shaft when a closing operation is performed, and releasing a connection between the closing shaft and the breaking shaft when a breaking operation is performed, wherein the plurality of springs are provided to have a rotationally symmetrical structure with respect to rotational axes of the closing shaft and the breaking shaft and cooperate with each other to rotate the closing shaft and the breaking shaft in a single direction.

The plurality of springs may be provided in three directions along the circumferences of the closing shaft and the breaking shaft, centered on the closing shaft and the breaking shaft, to form a delta structure.

The plurality of springs may be disposed in such a manner that lines extending therefrom form an equilateral triangular delta structure centered on the closing shaft and the breaking shaft.

Each of the plurality springs provided along the circumferences of the closing shaft and the breaking shaft may be configured as one of a pair of springs.

Each of the plurality of springs may be a tension spring.

Each of the plurality of springs may be a cold wound coil spring.

The closing shaft and the breaking shaft may be coaxial and independently rotatable, and the plurality of springs may include a plurality of closing springs connected to the closing shaft and a plurality of breaking springs connected to the breaking shaft.

When the closing spring is charged, the power transmission unit may release a connection between the closing shaft and the breaking shaft.

The power transmission unit may include: a closing actuating plate coupled to the closing shaft in such a manner that rotational behavior thereof is the same as that of the closing shaft; a breaking actuating plate coupled to the breaking shaft such that rotational behavior thereof is the same as that of the breaking shaft, receiving rotational force from the closing actuating plate when a closing operation is performed, and rotated independently of the closing actuating plate when a breaking operation is performed and when the closing spring is charged; and a clutch unit provided on the closing actuating plate and the breaking actuating plate, and transmitting rotational force from the closing actuating plate to the breaking actuating plate when a closing operation is performed.

The spring operation device may further include a charging cam rotating the closing actuating plate in a direction in which the closing spring is charged.

The spring operation device may further include a driving unit rotating the charging cam.

The spring operation device may further include a closing latch restraining rotation of the closing actuating plate and releasing the rotational restraint of the closing actuating plate when a closing operation is performed.

The spring operation device may further include a breaking latch restraining rotation of the breaking actuating plate and releasing the rotational restraint of the breaking actuating plate when a breaking operation is performed.

The clutch unit may include: a clutch frame provided on the breaking actuating plate; a clutch bar provided on the closing actuating plate, moved or rotated to be disposed in a first position or a second position, and fastened to the clutch frame in the first position, and separated from the clutch frame in the second position, wherein the clutch bar is disposed in the first position when the closing actuating plate is rotated at a charging completion rotation angle of the closing spring, and disposed in the second position when the closing actuating plate is rotated at a closing completion rotation angle.

The spring operation device may further include a closing side support plate, to which the closing shaft is rotatably coupled, disposed to face one side of the closing actuating plate.

The clutch bar may be rotatably provided on both sides of the closing actuating plate and may have a clutch roller protruding from one side of the closing actuating plate, and the closing side support plate may have a connection cam pressing the clutch roller upwardly to rotate the clutch bar to the first position when the closing actuating plate is rotated at a charging completion rotation angle of the closing spring and a release cam pressing the clutch roller downwardly to rotate the clutch bar to the second position when the closing actuating plate is rotated at a closing completion rotation angle.

The plurality of breaking springs may be charged through rotational force from the closing shaft and the breaking shaft rotated by elastic restoring force from the plurality of closing springs when a closing operation is performed.

The spring operation device may further include a closing side support plate to which the breaking shaft is rotatably coupled.

The power transmission unit may be provided between the closing side support plate and the breaking side support plate, the plurality of closing springs may be disposed on an outer side of the closing side support plate, and the plurality of breaking springs may be disposed on an outer side of the breaking side support plate.

The spring operation device may include an elasticity transmission member coupled to the closing shaft in such a manner that rotational behavior thereof is the same as that of the closing shaft, and extending in a radial direction of the closing shaft, the plurality of springs being connected to an outer portion of the elasticity transmission member.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
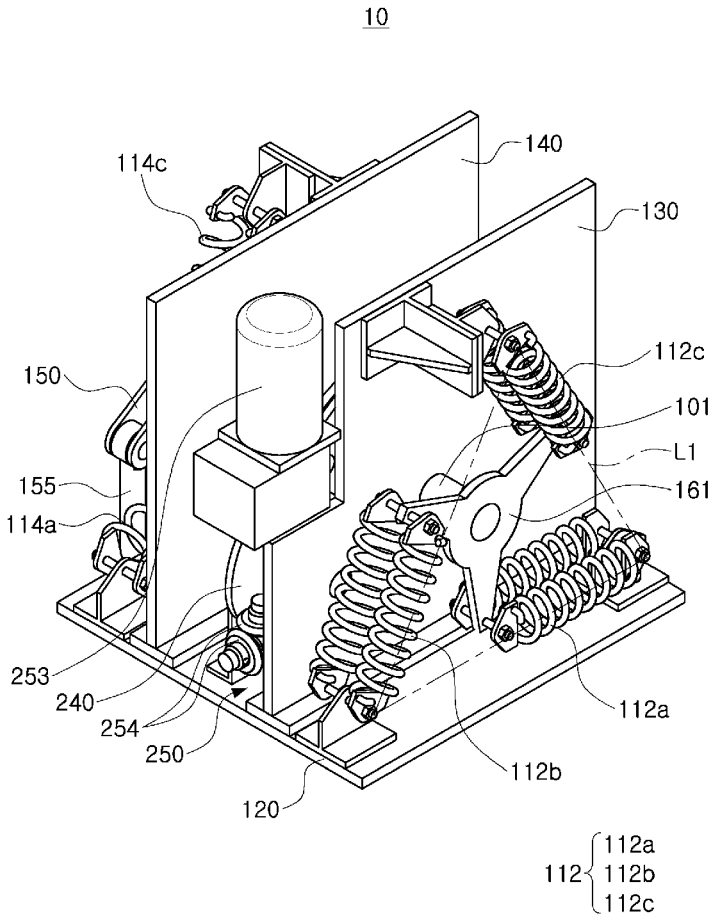
FIGS. 1 and 2 are perspective views illustrating a spring operation device according to an exemplary embodiment in the present disclosure, viewed from a closing spring side.
Figure 2:
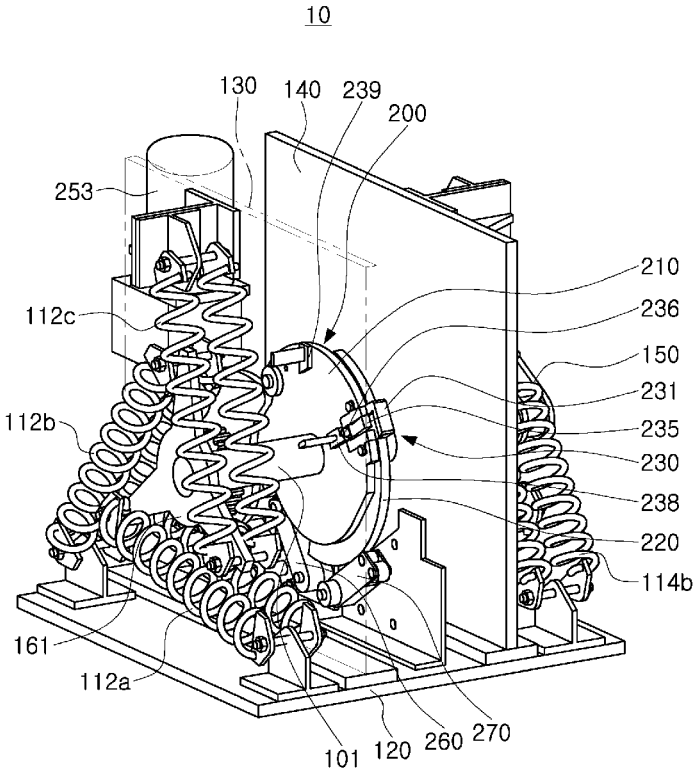
Figure 3:
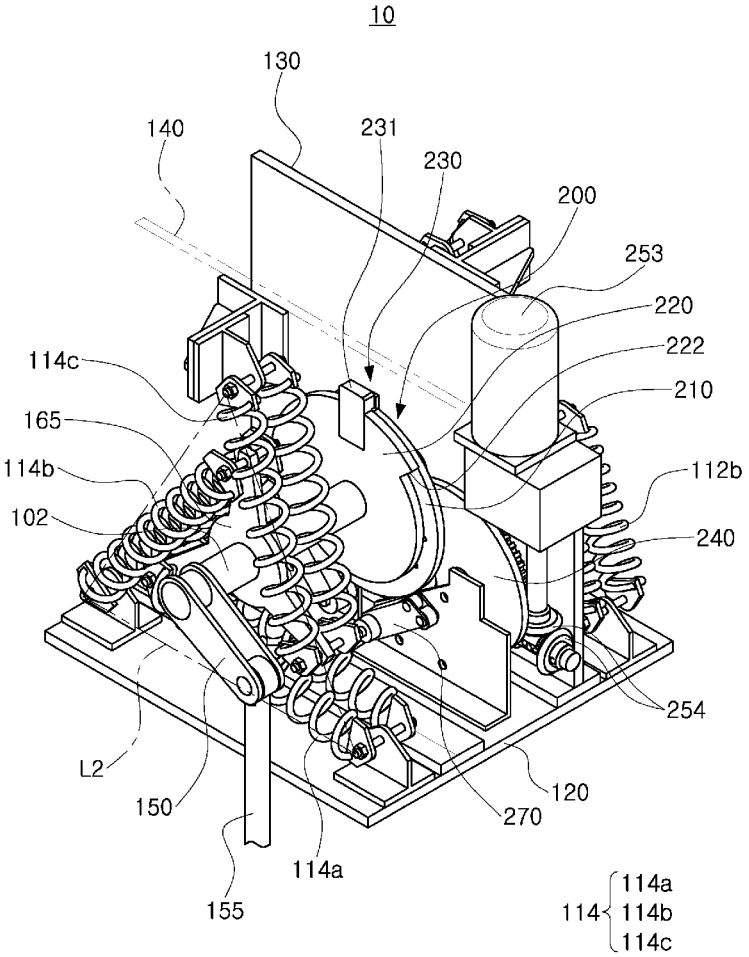
FIG. 3 is a perspective view illustrating a spring operation device according to an exemplary embodiment in the present disclosure, viewed from a breaking spring side.
Figure 4:
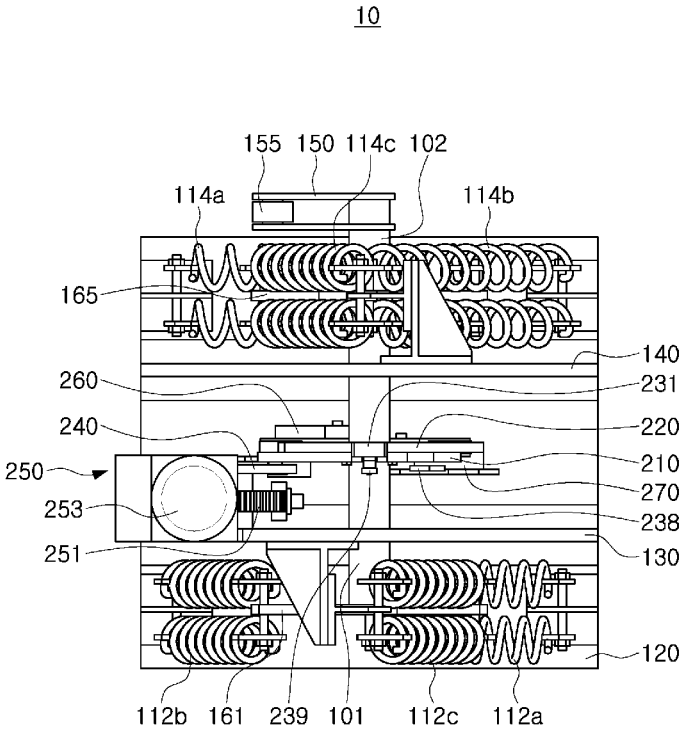
FIG. 4 is a plan view of a spring operation device according to an exemplary embodiment in the present disclosure.

Hereinafter, exemplary embodiments of the present disclosure will be described in detail with reference to the accompanying drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present disclosure. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

First, a structure and components of a spring operation device according to an exemplary embodiment in the present disclosure will be described with reference to FIGS. 1 through 9.

Hereinafter, in order to help in an understanding of the present disclosure, a direction of rotation of a rotating component will be expressed as a clockwise direction or a counterclockwise direction, and the clockwise direction and the counterclockwise direction are determined in relation to a device viewed from a closing spring 112 side.

Referring to FIGS. 1 through 9, a spring operation device 10 according to an exemplary embodiment in the present disclosure may include shafts 101 and 102 rotating to actuate a movable contactor (not shown) of a circuit breaker and a plurality of springs 112 and 114 transmitting elastic restoring force to the shafts 101 and 102 to rotate the shafts 101 and 102.

One end of each of the plurality of springs 112 and 114 may be eccentrically connected to each of the shafts 101 and 102, and the other end thereof may be fixed. The plurality of springs 112 and 114 may be provided along the circumference of each of the shafts 101 and 102.

Here, the plurality of springs 112 and 114 may be provided in a rotationally symmetrical structure in relation to rotational axes of the shafts 101 and 102 in order to rotate the shafts 101 and 102 in a clockwise direction or counterclockwise direction cooperatively.

In the spring operation device 10 according to an exemplary embodiment, since the plurality of springs 112 and 114 may cooperatively apply a great amount of rotational driving force to the shafts 101 and 102, small springs which have lower degrees of elastic restoring force and are smaller in volume than those of the single spring used in the related art spring operation device may be used as the plurality of springs 112 and 114.

Also, the spring operation device 10 according to an exemplary embodiment may have the closing spring 112 applying closing driving force to the movable contactor and a breaking spring 114 applying breaking driving force to the movable contactor, and the breaking spring 114 may be charged using elastic restoring force generated when the closing spring 112 is closed.

In the spring operation device 10 according to the exemplary embodiment illustrated in FIGS. 1 through 18, the plurality of springs 112 and 114 may be provided in three directions along the circumference of the shafts 101 and 102, centered on the shafts 101 and 102, forming a delta structure, but the present disclosure is not limited thereto and two springs may be provided on both sides of the shafts 101 and 102 or four or more springs may be provided to have a polygonal structure centered on the shafts 101 and 102.

Also, in the spring operation device 10 according to the exemplary embodiment illustrated in FIGS. 1 through 18, the shafts 101 and 102 may include a closing shaft 101 and a breaking shaft 102 in order to generate closing driving force and breaking driving force of the movable contactor.

Also, in the spring operation device 10 according to the exemplary embodiment illustrated in FIGS. 1 through 18, the plurality of springs 112 and 114 may include a plurality of closing springs 112 rotating the closing shaft 101 and a plurality of breaking springs 114 rotating the breaking shaft 102.

Hereinafter, the spring operation device 10 according to the exemplary embodiment illustrated in FIGS. 1 through 9 will be described in detail.

As illustrated in FIGS. 1 through 9, the spring operation device 10 according to an exemplary embodiment may include a base plate 120, a closing side support plate 130, a breaking side support plate 140, the closing shaft 101, the breaking shaft 102, a lever 150, a link 155, a plurality of closing springs 112, a closing side elasticity transmission member 161, a plurality of breaking springs 114, a closing side elasticity transmission member 165, a power transmission unit 200, a charging cam 240, a driving unit 250, a closing latch 260, and a breaking latch 270.

The base plate 120 may support the closing side support plate 130 and the breaking side support plate 140 in such a manner that the closing side support plate 130 and the breaking side support plate 140 are fixed to be spaced apart from each other.

Also, in an exemplary embodiment, the closing latch 260 and the breaking latch 270 (to be described hereinafter) may be installed on the base plate 120.

The closing side support plate 130 may be erected on an upper surface of the base plate 120, and may forma structure on which the closing shaft 101 and the driving unit 250 (to be described hereinafter) are to be installed.

The breaking side support plate 140 may be erected on the upper surface of the base plate 120 and face the closing side support plate 130.

In an exemplary embodiment, the closing side support plate 130 and the breaking side support plate 140 may be spaced apart from each other.

Here, the power transmission unit 200, the driving unit 250, the closing latch 260, and the breaking latch 270 as described hereinafter may be disposed in a space between the closing side support plate 130 and the breaking side support plate 140.

The closing side shaft 101 may be rotatably provided on the closing side support plate 130. The closing shaft 101 may be rotated upon receiving elastic restoring force from the closing spring 112 as described hereinafter.

The breaking shaft 102 may be rotatably provided on the breaking side support plate 140. The breaking shaft 102 may be rotated upon receiving elastic restoring force from the breaking spring 114 as described hereinafter.

The closing shaft 101 and the breaking shaft 102 may be connected to each other in an axial direction. Here, the closing shaft 101 and the breaking shaft 102 may be connected in a space between the closing side support plate 130 and the breaking side support plate 140.

The closing shaft 101 and the breaking shaft 102 may be connected in an axial direction so as to be coaxial.

However, the closing shaft 101 and the breaking shaft 102 are configured to be independently rotatable. That is, the closing shaft 101 may be rotatably fastened to the breaking shaft 102.

Figure 5:
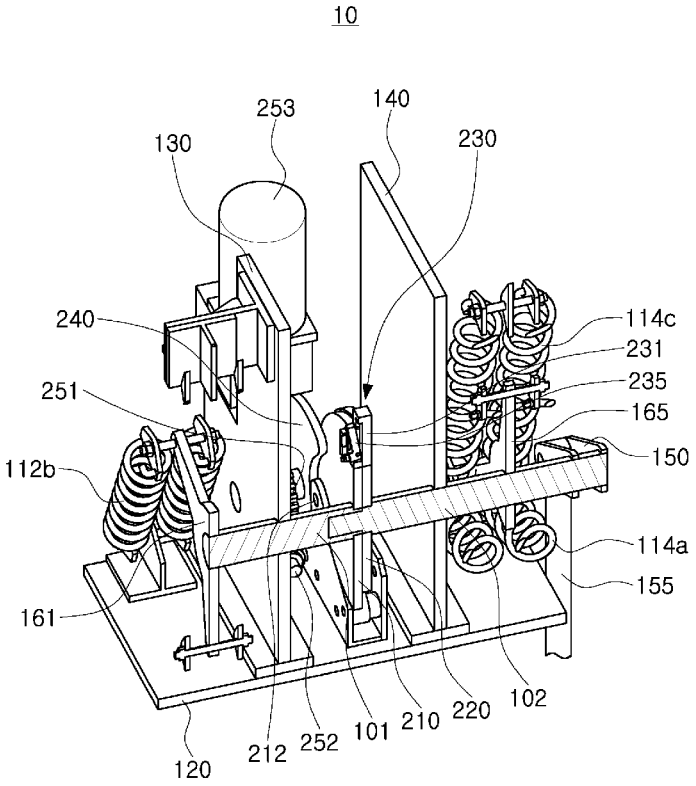
FIG. 5 is a cross-sectional view of the spring operation device illustrated in FIG. 1, taken along line A-A'.

To this end, for example, as illustrated in FIG. 5, a portion of an end of the breaking shaft 102 may be inserted into an end of the closing shaft 101 in an axial direction, but the present disclosure is not limited thereto.

In this manner, the structure in which the closing shaft 101 and the breaking shaft 102 are coaxially provided advantageously simplifies a mechanical connection structure for power transmission between the closing shaft 101 and the breaking shaft 102 which apply power to the movable contactor in mutually opposite directions and the movable contactor.

Alternatively, in a case in which the closing shaft 101 and the breaking shaft 102 are configured to have different axes, a complicated link or lever structure is required to connect the closing shaft 101 or the breaking shaft 102 to the movable contactor, complicating a mechanical connection structure, increasing components, and increasing a device in size.

Also, in the spring operation device 10 according to the exemplary embodiment, the spring operation device 10, since the closing shaft 101 and the breaking shaft 102 are configured to be independently rotatable, the closing shaft 101 and the closing spring 112 (to be described hereinafter) may not interfere with rotational behavior of the breaking shaft 102 when a breaking operation is performed.

Also, although not shown, in an exemplary embodiment, the closing shaft 101 and the breaking shaft 102 may be coupled to the closing side support plate 130 and the breaking side support plate 140, respectively, through a bearing (not shown) to ensure a smooth rotational behavior.

The lever 150 may be coupled to the breaking shaft 102 in such a manner that rotation behaviors thereof are the same. One end of the lever 150 may be coupled to the breaking shaft 102, and the other end thereof may extend in a radial direction of the breaking shaft 102.

One end of the link 155 may be rotatably coupled to an end of the lever 150, and the other end thereof may be coupled to the movable contactor (not shown) of the circuit breaker. The link 155 may transmit rotational force from the lever 150 to the movable contactor.

The plurality of closing springs 112 may be disposed on an outer side of the closing side support plate 130, and may apply elastic restoring force to the closing shaft 101 in a counterclockwise direction. To this end, the plurality of closing springs 112 may be disposed to be rotationally symmetrical with respect to the closing shaft 101.

In an exemplary embodiment, the plurality of closing springs 112 may be provided in three directions around the closing shaft 101, forming a delta structure.

In an exemplary embodiment, the plurality of closing springs 112 may include a first closing spring 112*a* disposed horizontally below the closing shaft 101, a second closing spring 112*b* disposed to be sloped at an angle of 60° to the left of the closing shaft 101, and a third closing spring 112*c* disposed to be sloped at an angle of 120° above the closing shaft 101.

In this configuration, extending lines L1 of the first closing spring 112*a*, the second closing spring 112*b*, and the third closing spring 112*c* may form an equilateral triangular delta structure centered on the closing shaft 101.

Here, one end of each of the first closing spring 112*a*, the second closing spring 112*b*, and the third closing spring 112*c* may be rotatably coupled to the base plate 120 or the closing side support plate 130, and the other end thereof may be rotatably coupled to the closing side elasticity transmission member 161 as described hereinafter.

Also, in an exemplary embodiment, the first closing spring 112*a*, the second closing spring 112*b*, and the third closing spring 112*c* may be configured as substantially the same springs 112 and 114 to facilitate a design.

If specifications such as a length, a thickness, a degree of elastic restoring force, and the like, of the first closing spring 112*a*, the second closing spring 112*b*, and the third closing spring 112*c* are different, a disposition structure of each of the first closing spring 112*a*, the second closing spring 112*b*, and the third closing spring 112*c* may be complicated to effectively use elastic restoring force thereof.

Also, in a case in which springs 112 and 114 having different specifications are disposed to have an equilateral triangular delta structure, force applied by the plurality of springs 112 and 114 to the closing shaft 101 is unbalanced, increasing fatigue of some of the springs 112 and 114.

Also, in an exemplary embodiment, the first closing spring 112*a*, the second closing spring 112*b*, and the third closing spring 112*c* may be configured a pair of same springs 112 and 114 disposed in parallel, but the present disclosure is not limited thereto. For reference, in a case in which a plurality of springs 112 and 114 are disposed in parallel, a greater amount of elastic restoring force may be applied to the closing shaft 101.

Thus, for example, the first closing spring 112*a*, the second closing spring 112*b*, and the third closing spring 112*c* may be configured as cold wound coil springs 112 and 114 having low degree of elastic restoring force and being small in volume, compared with the hot wound coil springs 112 and 114, but the present disclosure is not limited thereto and the first closing spring 112*a*, the second closing spring 112*b*, and the third closing spring 112*c* may also be configured as elastic members formed of any other materials and shapes.

In general, the cold wound coil springs 112 and 114 are low in price, compared with the hot wound coil springs 112 and 114 due to a difference in material and manufacturing method. Thus, the spring operation device 10 according to an exemplary embodiment of the present disclosure using the cold wound coil springs 112 and 114 is advantageous in that manufacturing costs thereof are reduced, compared with the related art spring operation device.

Meanwhile, in a case in which the first closing spring 112*a*, the second closing spring 112*b*, and the third closing spring 112*c* are configured as compression springs 112 and 114, bodies of the springs 112 and 114 may be folded when an amount of compression is high, causing malfunctions. Thus, in an exemplary embodiment, the first closing spring 112*a*, the second closing spring 112*b*, and the third closing spring 112*c* may be configured as tensile springs 112 and 114 applying elastic restoring force in a direction in which the first closing spring 112*a*, the second closing spring 112*b*, and the third closing spring 112*c* are compressed from a tensioned state, but the present disclosure is not limited thereto.

Here, however, in a case in which the plurality of closing springs 112 receiving force in a direction of rotation of the closing shaft 101 are configured as compression springs of which both ends are simply fixed without a separate guide, the compression springs may be bent when compressed for charging, causing malfunctions.

The closing side elasticity transmission member 161 may be coupled to the closing shaft 101 such that rotational behavior thereof is the same as that of the closing shaft 101, and the first closing spring 112*a*, the second closing spring 112*b*, and the third closing spring 112*c* may be connected to outer portions thereof.

The closing side elasticity transmission member 161 may transmit elastic restoring force of the first closing spring 112*a*, the second closing spring 112*b*, and the third closing spring 112*c* to the closing shaft 101.

The plurality of breaking springs 114 may be disposed on an outer side of the breaking side support plate 140, and may apply elastic restoring force to the breaking shaft 102 in a clockwise direction. To this end, the plurality of breaking springs 114 may be disposed to be rotationally symmetrical with respect to the breaking shaft 102.

That is, the plurality of breaking springs 114 may apply elastic restoring force to the breaking shaft 102 in a direction opposite to that of the plurality of closing springs 112 as described above.

In an exemplary embodiment, the plurality of breaking springs 114 may be provided in three directions around the breaking shaft 102, forming a delta structure.

In an exemplary embodiment, the plurality of breaking springs 114 may include a first breaking spring 114*a* disposed horizontally below the breaking shaft 102, a second breaking spring 114*b* disposed to be sloped at an angle of 60° on the left of the breaking shaft 102, and a third breaking spring 114*c* disposed to be sloped at an angle of 120° above the breaking shaft 102.

In this configuration, extending lines L2 of the first breaking spring 114*a*, the second breaking spring 114*b*, and the third breaking spring 114*c* may form an equilateral triangular delta structure centered on the breaking shaft 102.

Here, one end of each of the first breaking spring 114*a*, the second breaking spring 114*b*, and the third breaking spring 114*c* may be rotatably coupled to the base plate 120 or the breaking side support plate 140, and the other end thereof may be rotatably coupled to the breaking side elasticity transmission member 165 as described hereinafter.

Also, in an exemplary embodiment, like the first closing spring 112*a*, the second closing spring 112*b*, and the third closing spring 112*c* as described above, the first breaking spring 114*a*, the second breaking spring 114*b*, and the third breaking spring 114*c* may be configured as substantially the same springs 112 and 114 to facilitate designing.

Also, in an exemplary embodiment, like the first closing spring 112*a*, the second closing spring 112*b*, and the third closing spring 112*c* as described above, the first breaking spring 114*a*, the second breaking spring 114*b*, and the third breaking spring 114*c* may be configured as a pair of same springs 112 and 114 disposed in parallel, may be configured as cold wound coil springs 112 and 114, or may be configured as tensile springs 112 and 114, but the present disclosure is not limited thereto and the first breaking spring 114*a*, the second breaking spring 114*b*, and the third breaking spring 114*c* may also be configured as elastic members formed of any other materials and shapes.

Here, however, as mentioned above with reference to the closing spring 101, the plurality of closing springs 112 also receive force in a direction of rotation of the breaking shaft 102, and thus, in a case in which the plurality of breaking springs 114 are configured as compression springs whose both ends are simply fixed without a separate guide, the compression springs may be bent when compressed for charging, causing malfunction.

The breaking side elasticity transmission member 165 may be coupled to the breaking shaft 102 such that rotational behavior thereof is the same as that of the breaking shaft 102, and the first breaking spring 114*a*, the second breaking spring 114*b*, and the third breaking spring 114*c* may be connected to outer portions thereof.

The breaking side elasticity transmission member 165 may transmit elastic restoring force of the first breaking spring 114*a*, the second breaking spring 114*b*, and the third breaking spring 114*c* to the breaking shaft 102.

The power transmission unit 200 connects the closing shaft 101 and the breaking shaft 102. Here, when a closing operation is performed, the power transmission unit 200 connects the closing shaft 101 and the breaking shaft 102 so that the closing shaft 101 and the breaking shaft 102 are rotated together, and when a breaking operation is performed and when the closing spring 112 is charged, the power transmission unit 200 may release a connection of the closing shaft 101 and the breaking shaft 102 so that the closing shaft 101 and the breaking shaft 102 may be independently rotated.

Here, charging of the closing spring 112 refers to an operation in which the closing spring 112 is tensioned as the closing shaft 101 is rotated in a clockwise direction, thus storing elastic strain energy in the closing spring 112.

In order to realize such an operation, in an exemplary embodiment, the power transmission unit 200 may include a closing actuating plate 210, a breaking actuating plate 220, and a clutch unit 230.

The closing actuating plate 210 may be provided on the closing shaft 101 in such a manner that rotational behavior thereof is the same as that of the closing shaft 101.

In an exemplary embodiment, the closing actuating plate 210 may include a motor cam roller 212, a clutch bar 235 of the clutch unit as described hereinafter, and a closing latch surface 214.

Here, the motor cam roller 212 may be disposed to be eccentric on the closing actuating plate 210, and may serve as a medium transmitting rotational force from the charging cam 240 to the closing actuating plate 210 so that the charging cam 240 as described hereinafter rotates the closing actuating plate 210.

The closing latch surface 214 is a sloped surface formed on a portion of the edge of the closing actuating plate 210. The closing latch surface 214 is provided to be caught by the closing latch 260 as described hereinafter to restrain a rotation of the closing actuating plate 210 in a counterclockwise direction.

The clutch bar 235 will be described when the clutch unit 230 is described hereinafter.

The breaking actuating plate 220 may be provided on the breaking shaft 102 in such a manner that a rotation behavior thereof is the same as that of the breaking shaft 102. When a closing operation is performed, the breaking actuating plate 220 may receive rotational force from the closing actuating plate 210 in such a manner that rotational behavior thereof is the same as that of the closing actuating plate 210, and when a breaking operation is performed and when the closing spring 112 is charged, the breaking actuating plate 220 may be rotated independently of the closing actuating plate 210.

In an exemplary embodiment, the breaking actuating plate 220 may have a clutch frame 231 of the clutch unit 230 as described above and a breaking latch surface 222.

Here, the clutch frame 231 will be described when the clutch unit 230 is described hereinafter.

Also, the breaking latch surface 222 is a sloped surface formed on a portion of the edge of the breaking actuating plate 220. The breaking latch surface 222 is provided to be caught by a breaking latch 270 as described hereinafter to restrain rotation of the breaking actuating plate 220 in a clockwise direction.

The clutch unit 230 may be provided to cause the closing actuating plate 210 and the breaking actuating plate 220 to interwork with each other. When a closing operation is performed, the clutch unit 230 may connect the closing actuating plate 210 and the breaking actuating plate 220 so that rotational force from the closing actuating plate 210 is transmitted to the breaking actuating plate 220, and when a breaking operation is performed and when the closing spring 112 is charged, the clutch unit 230 may release connection between the closing actuating plate 210 and the breaking actuating plate 220.

In order to realize such an operation, in an exemplary embodiment, the clutch unit 230 may include the clutch frame 231, the clutch bar 235, a clutch roller 236, a connection cam 238, and a release cam 239.

The clutch frame 231 may protrude from the edge of the breaking actuating plate 220 and may be fixed to the breaking actuating plate 220.

When the clutch bar 235 is rotated in a counterclockwise direction as the closing actuating plate 210 rotates in the counterclockwise direction, the clutch frame 231 is caught by the clutch bar 235, transmitting rotational force from the closing actuating plate 210 to the breaking actuating plate 220.

Conversely, in a case in which the clutch bar 235 is rotated in a clockwise direction as the closing actuating plate 210 is rotated in the clockwise direction, the clutch frame 231 is released from connection with the clutch bar 235, allowing the closing actuating plate 210 and the breaking actuating plate 220 to be independently operated.

Figure 8:
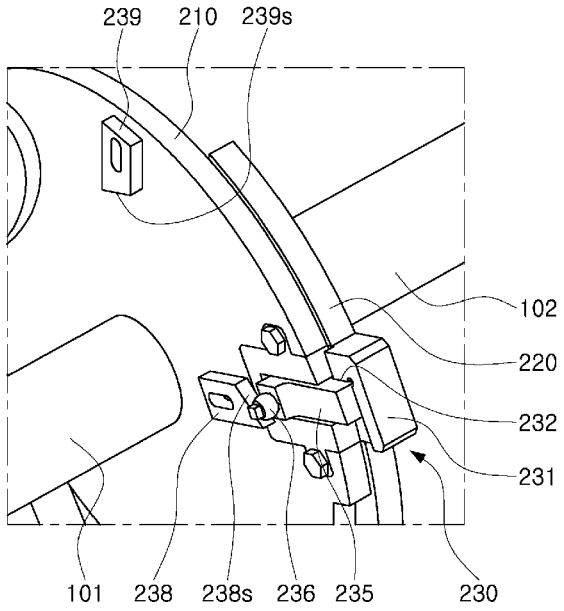
FIG. 8 is a perspective view illustrating a state in which a clutch bar included in a clutch unit of the power transmission unit illustrated in FIG. 6 is disposed in a first position.
Figure 9:
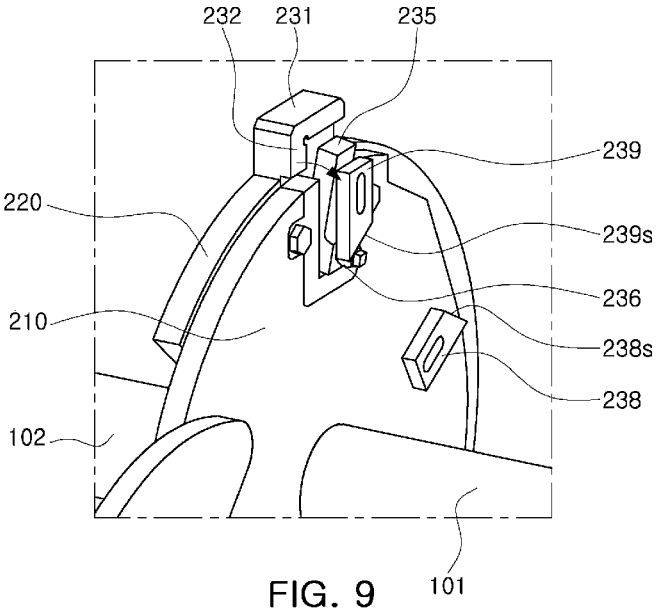
FIG. 9 is a perspective view illustrating a state in which a clutch bar included in a clutch unit of the power transmission unit illustrated in FIG. 6 is disposed in a second position.

To this end, in an exemplary embodiment, as illustrated in FIGS. 8 and 9, the clutch frame 231 may have a plate-like structure protruding from the edge of the breaking actuating plate 220 and allowing the clutch bar 235 to be brought into contact therewith, and may have an arresting protrusion 232 allowing the clutch bar 235 to be caught thereby on the counterclockwise direction side, and the clockwise direction side thereof may be open to allow the clutch bar 235 to freely pass therethrough.

The clutch bar 235 may be provided to protrude from the edge of the closing actuating plate 210 and may be rotated or moved in both surface directions of the closing actuating plate 210.

The clutch bar 2335 may be disposed in a first position in which the clutch bar 235 is caught by the arresting protrusion 232 of the clutch frame 231, and in a second position in which the clutch bar 235 is not caught by the arresting protrusion 232.

In the first position, the clutch bar 235 is in contact with the clutch frame 231, and thus, when the closing actuating plate 210 rotates in a counterclockwise direction, the clutch bar 235 may be caught by the arresting protrusion 232 to transmit rotational force from the closing actuating plate 210 to the clutch frame 231.

Also, in the second position, the clutch bar 235 may be separated from the clutch frame 231, and thus, when the breaking actuating plate 220 rotates in a clockwise direction, the clutch bar 235 may be rotated independently of the closing actuating plate 210.

In an exemplary embodiment, as illustrated in FIGS. 8 and 9, a lower end portion of the clutch bar 235 may be hinge-coupled to the closing actuating plate 210 and rotated. In FIG. 8, it is illustrated that the clutch bar 235 is disposed in the first position, and in FIG. 9, it is illustrated that the clutch bar 235 is disposed in the second position.

The clutch bar 235 may be rotated by the clutch roller 26 moving through the connection cam 238 and the release cam 239 as described hereinafter.

The clutch roller 236 may protrude from an outer surface of the clutch bar 235, and may be pressed by the connection cam 238 and the release cam 239 to cause the clutch bar 235 to be rotated.

The connection cam 238 may be fixed to the closing side support plate 130, and in a case in which the closing actuating plate 210 is rotated at a charging completion rotation angle of the closing spring 112, the connection cam 238 may press the clutch roller 236 upwardly to allow the clutch bar 235 to be rotated to the first position. Here, the charging completion rotation angle of the closing spring 112 refers to a rotation angle of the closing actuating plate 210 when charging of the closing spring 112 is completed.

In an exemplary embodiment, the connection cam 238 may have a sloped surface 238*s* upwardly sloped in a clockwise direction to allow the clutch roller 2336 to be moved upwardly. As the closing actuating plate 210 is rotated in the clockwise direction, the clutch roller 236 may be rotated in the clockwise direction and moved on the sloped surface 238*s* of the connection cam 238.

The release cam 239 may be fixed to the closing side support plate 130, and in a case in which the closing actuating plate 210 is rotated in a closing completion rotation angle, the release cam 239 may press the clutch roller 236 downwardly to allow the clutch bar 235 to be rotated to the second position. Here, the closing completion rotation angle refers to a rotation angle of the closing actuating plate 210 when closing of the movable contactor (not shown) is completed.

In an exemplary embodiment, the release cam 239 may have a sloped surface 239*a* downwardly sloped in a counterclockwise direction to allow the clutch roller 2336 to be moved downwardly. As the closing actuating plate 210 is rotated in the counterclockwise direction, the clutch roller 236 may be rotated in the counterclockwise direction and moved on the sloped surface 239*s* of the release cam 239.

In the configuration, when charging of the closing spring 112 is completed, the clutch bar 235 and the clutch frame 231 may be connected to each other, and when closing of the movable contactor is completed, connection between the clutch bar 235 and the clutch frame 231 may be released.

Figure 6:
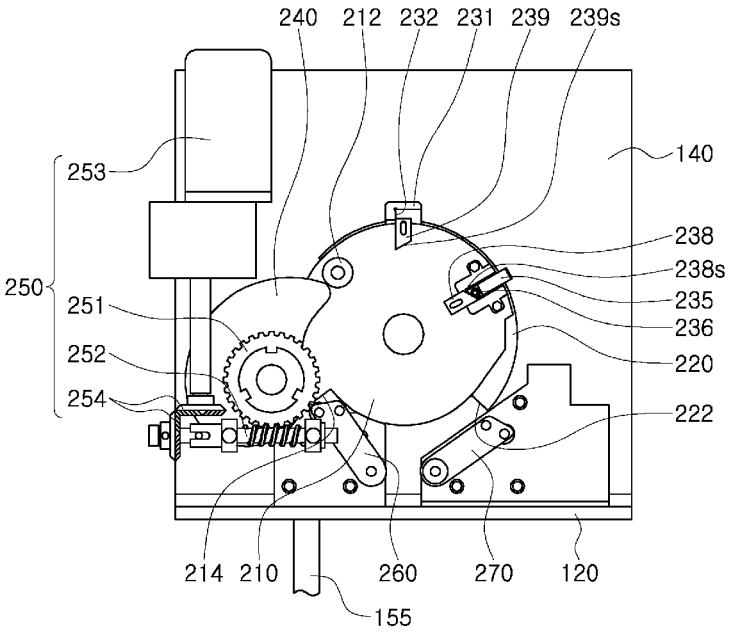
FIG. 6 is a side view illustrating a power transmission unit and a driving unit included in a spring operation device according to an exemplary embodiment in the present disclosure.
Figure 7:
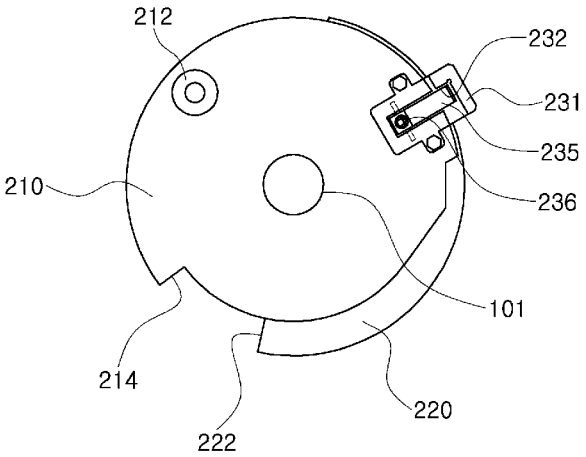
FIG. 7 is a side view of a power transmission unit of a spring operation device according to an exemplary embodiment in the present disclosure.

As illustrated in FIG. 6, the charging cam 240 may be disposed on one side of the closing actuating plate 210 and rotate the closing actuating plate 210 in a direction in which the closing spring 112 is charged, that is, in a counterclockwise direction.

In an exemplary embodiment, the charging cam 240 may be rotated by the driving unit 250 in a counterclockwise direction, and when rotated, the edge of the charging cam 240 may press the motor cam roller 212 of the closing actuating plate 210 to rotate the closing actuating plate 210 in a clockwise direction.

The driving unit 250 may rotate the charging cam 240 in the clockwise direction.

In an exemplary embodiment, the driving unit 250 may include a worm gear 251 coupled to the charging cam 240, a worm 252 rotating to rotate the worm gear 251, a driving motor 253 for rotating the worm 252, and a bevel gear 254 transmitting power from the driving motor 253 to the worm 252. However, the present disclosure is not limited thereto and the driving unit 250 may be configured as any mechanical element as long as it can rotate the charging cam 240.

The closing latch 260 may be provided on one side of the closing actuating plate 210, and may be caught by the closing latch surface 214 of the closing actuating plate 210 to restrain a rotation of the closing actuating plate 210 in a counterclockwise direction, and when a closing operation is performed, the closing latch 260 may be released from contact with the closing latch surface 214 to release rotational restraint of the closing actuating plate 210.

The closing latch 260 may be controlled in operation according to an external signal, and when a closing signal is transmitted, the closing latch 260 may be rotated in a counterclockwise direction to release rotational restraint of the closing actuating plate 210.

The breaking latch 270 may be provided on one side of the breaking actuating plate 220, and may be caught by the breaking latch surface 222 of the breaking actuating plate 220 to restrain rotation of the breaking actuating plate 220 in a clockwise direction, and when a breaking operation is performed, the breaking latch 270 may be released from contact with the breaking latch surface 222 to release rotational restraint of the breaking actuating plate 220.

Like the closing latch 260, the breaking latch 270 may be controlled in operation according to an external signal, and when a breaking signal is transmitted, the breaking latch 270 may be rotated in a clockwise direction to release rotational restraint of the breaking actuating plate 220.

In the spring operation device 10 according to an exemplary embodiment of the present disclosure as described above, the power transmission unit 200, the driving unit 250, the closing latch 260, and the breaking latch 270 may be disposed between the closing side support plate 130 and the breaking side support plate 140, the closing spring 112 may be disposed on an outer side of the closing side support plate 130, and the breaking spring 114 may be disposed on an outer side of the breaking side support plate 140.

In the spring operation device 10 according to an exemplary embodiment, the both sides of each of the closing side support plate 130 and the breaking side support plate 140 forming a basic framework of the spring operation device 10 may be utilized to accommodate components, advantageously minimizing a volume of the device and the number of components.

Hereinafter, a charging operation, a closing operation, and a breaking operation of the spring operation device 10 according to an exemplary embodiment will be described with reference to FIGS. 10 through 18.

First, a charging operation of the closing spring 112 will be described with reference to FIGS. 10 through 13.

Figure 10:
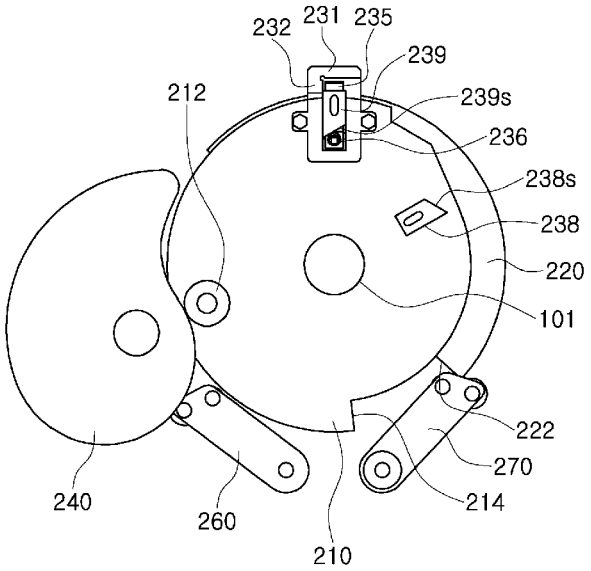
FIGS. 10 and 11 are views illustrating operational states of a power transmission unit and a driving unit when a closing spring included in a spring operation device according to an exemplary embodiment in the present disclosure is charged.
Figure 11:
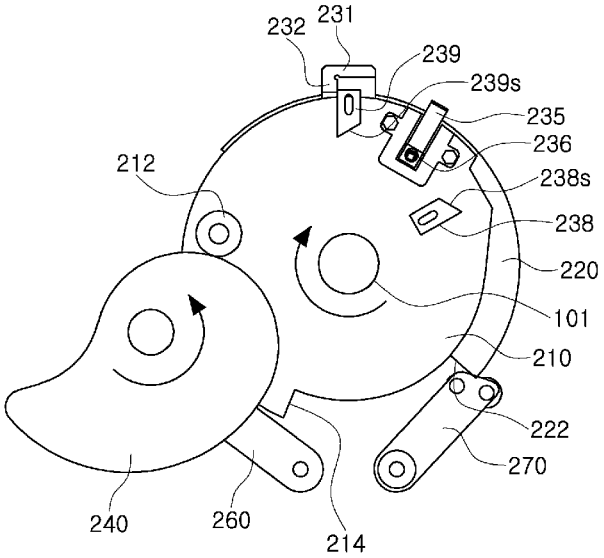
Figure 12:
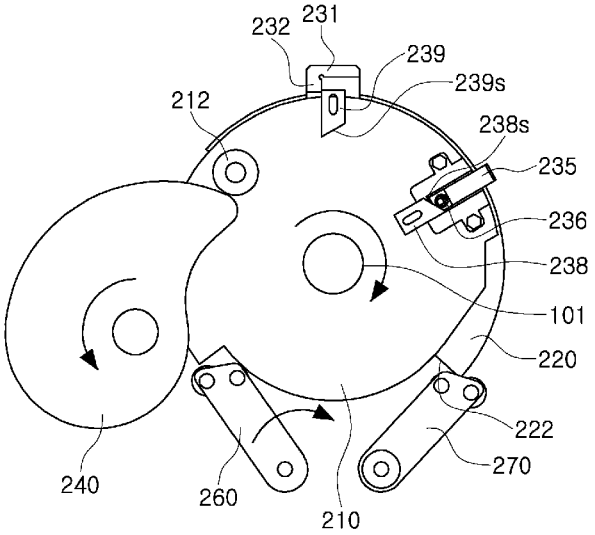
FIG. 12 is a view illustrating an operational state of a power transmission unit and a driving unit when charging of a closing spring included in a spring operation device according to an exemplary embodiment in the present disclosure is completed.
Figure 13:
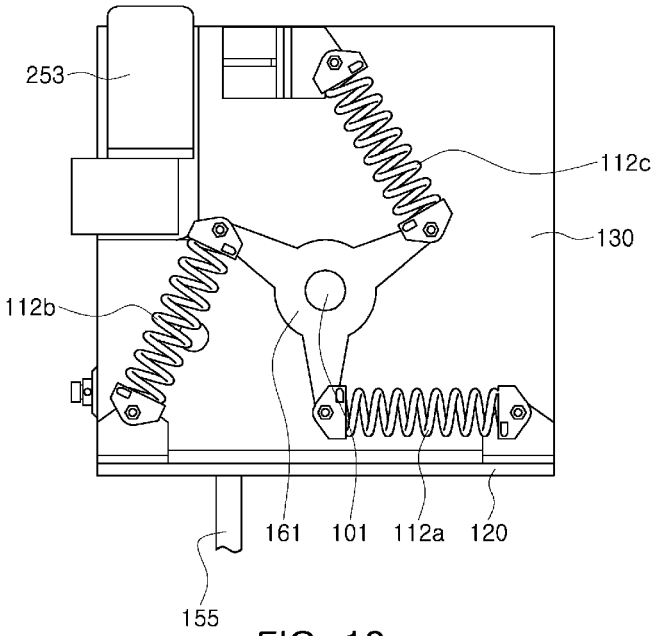
FIG. 13 is a side view illustrating a charging completed state of a closing spring included in a spring operation device according to an exemplary embodiment in the present disclosure.

FIGS. 10 and 11 illustrate an operational state of a power transmission unit and the driving unit 250 when the closing spring 112 is charged, FIG. 12 illustrates the power transmission unit and the driving unit 250 when charging of the closing spring 112 is completed, and FIG. 13 illustrates a state of the completely charged closing spring 112.

As illustrated in FIG. 10, in a case in which closing of the movable contactor (not shown) is completed, the closing actuating plate 210 may be in a state of having been rotated in a counterclockwise direction and the clutch bar 235 is disposed in the second position by the release cam 239.

Here, when the driving unit 250 operates, as illustrated in FIG. 11, the charging cam 240 is rotated in the counterclockwise direction to press the motor cam roller 212 of the closing actuating plate 210 to rotate the closing actuating plate 210.

When the closing actuating plate 210 is rotated in a clockwise direction, the closing shaft 101 and the closing side elasticity transmission member 161 are rotated in the clockwise direction, causing the first closing spring 112*a*, the second closing spring 112*b*, and the third closing spring 112*c* to be tensioned to store elastic strain energy.

Here, the clutch bar 235 of the clutch unit 230 moves from the clutch frame 231 in a clockwise direction, and accordingly, the closing actuating plate 210 is rotated independently of the breaking actuating plate 220 and the breaking actuating plate 220 may be fixed.

Meanwhile, as illustrated in FIG. 12, in a case in which the closing actuating plate 210 has rotated up to an angle at which charging of the closing spring 112 is completed, the charging cam 240 continuously rotates in the clockwise direction so as not to move the motor can roller 212 any longer and the closing latch 260 is caught by the closing latch surface 214.

Here, the closing latch 260 may restrain the closing actuating plate 210 and the closing shaft 101 from rotating in a counterclockwise direction due to elastic restoring force from the closing spring 112.

In a case in which charging of the closing spring 112 is completed, the clutch bar 235 of the clutch unit 230 is disposed in the first position by the connection cam 238.

Meanwhile, in a case in which charging of the closing spring 112 is completed and rotation of the closing actuating plate 210 is restrained by the closing latch 260, the first closing spring 112*a*, the second closing spring 112*b*, and the third closing spring 112*c* may be tensioned to maintain a state of storing elastic strain energy as illustrated in FIG. 13.

Meanwhile, the spring operation device 10 according to an exemplary embodiment may be configured in such a manner that a charging operation of the closing spring 112 is automatically performed immediately after closing of the circuit breaker is completed.

Hereinafter, a closing operation will be described with reference to FIGS. 14 through 16.

Figure 14:
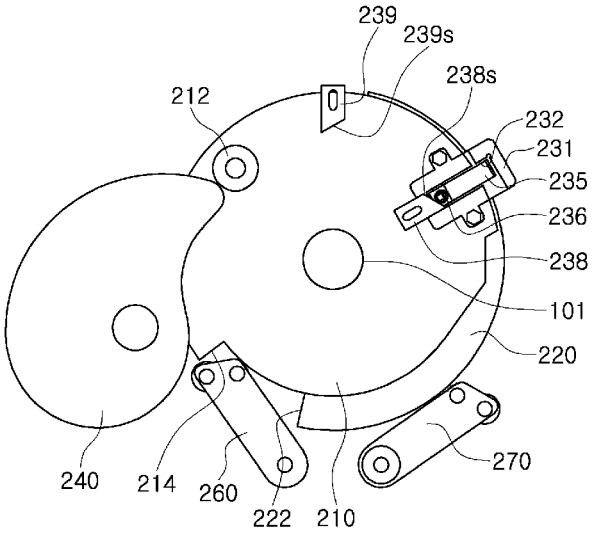
FIGS. 14 and 15 are views illustrating an operational state of a power transmission unit when a spring operation device according to an exemplary embodiment in the present disclosure is closed.
Figure 15:
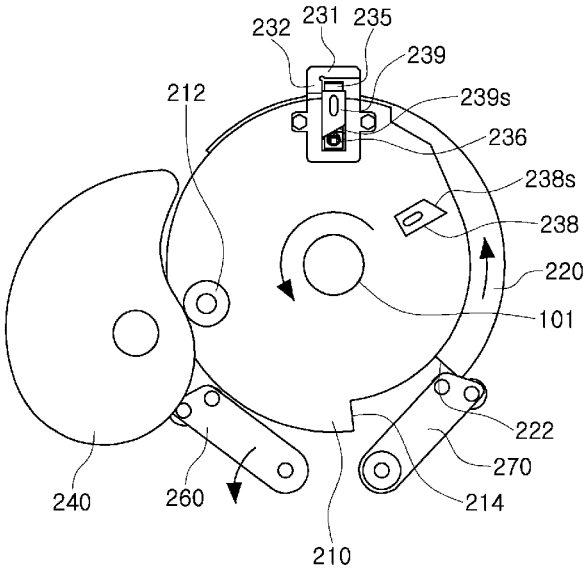
Figure 16:
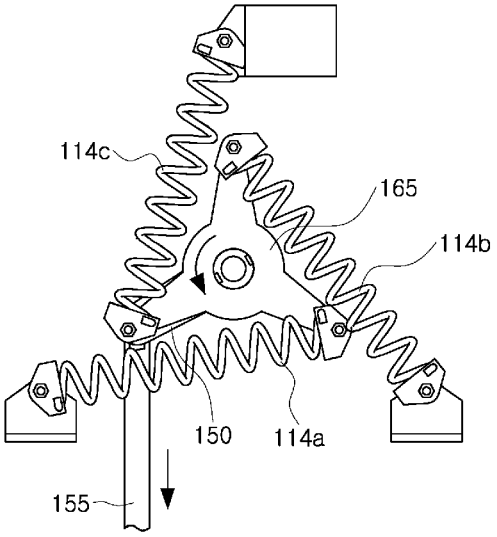
FIG. 16 is a side view illustrating operations of a lever, a link, and a breaking spring when a spring operation device according to an exemplary embodiment in the present disclosure is closed.

FIGS. 14 and 15 illustrate an operational state of the power transmission unit when a closing operation is performed, and FIG. 16 illustrates operations of the lever 150, the link 155, and the breaking spring 114 when a closing operation is performed.

As illustrated in FIG. 14, closing the movable contactor presupposes a breaking state in which a power system is open. In the breaking state, the breaking actuating plate 220 is in a state of having been rotated in a clockwise direction so that the clutch frame 231 is disposed in the position of the connection cam 238.

In this state, as illustrated in FIG. 15, when the closing latch 260 is operated to release rotational restraint of the closing actuating plate 210, the closing shaft 101 and the closing actuating plate 210 are rotated in a counterclockwise direction through elastic restoring force of the first closing spring 112*a*, the second closing spring 112*b*, and the third closing spring 112*c*.

Here, since the clutch bar 235 is disposed in the first position and caught by the arresting protrusion 232 of the clutch frame 231, rotational force of the closing actuating plate 210 is transmitted to the breaking actuating plate 220 through the clutch bar 235 and the clutch frame 231.

Accordingly, when the closing operation is performed, the breaking actuating plate 220 may be rotated in a counterclockwise direction and the breaking shaft 102 is also rotated in the counterclockwise direction according to the rotation of the breaking actuating plate 220.

Also, as illustrated in FIG. 16, as the breaking shaft 102 is rotated in the counterclockwise direction, the lever 150 is rotated in the counterclockwise direction, whereby the link 155 connected to the lever 150 is moved to move the movable contactor in a closing direction.

Here, the first breaking spring 114*a*, the second breaking spring 114*b*, and the third breaking spring 114*c* connected to the breaking shaft 102 through the breaking side elasticity transmission member 165 may be tensioned according to the rotation of the breaking shaft 102 in the counterclockwise direction to store elastic strain energy.

In other words, the spring operation device 10 according to an exemplary embodiment may charge the breaking spring 114 using elastic restoring force generated due to a discharging operation of the closing spring 112 when the circuit breaker is closed.

Meanwhile, when closing of the circuit breaker is completed, rotation of the breaking actuating plate 220 may be restrained as the breaking latch 270 is caught by the breaking latch surface 222. Here, the first breaking spring 114*a*, the second breaking spring 114*b*, and the third breaking spring 114*c* may apply elastic restoring force to the breaking actuating plate 220 in a clockwise direction.

Finally, a breaking operation will be described with reference to FIGS. 17 and 18.

Figure 17:
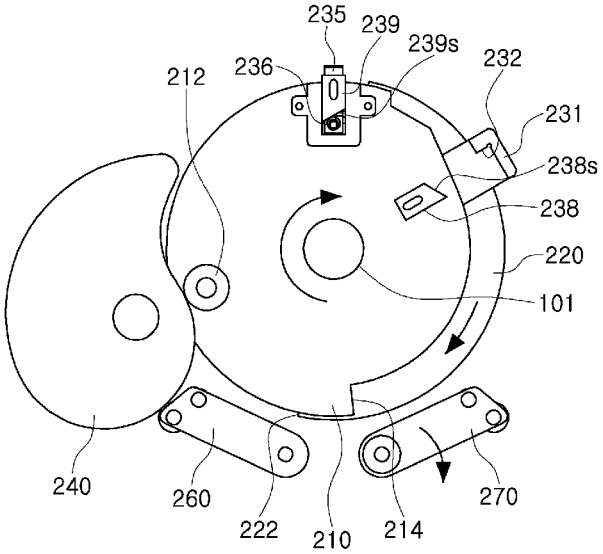
FIG. 17 is a side view illustrating a power transmission unit when a spring operation device according to an exemplary embodiment in the present disclosure is broken.
Figure 18:
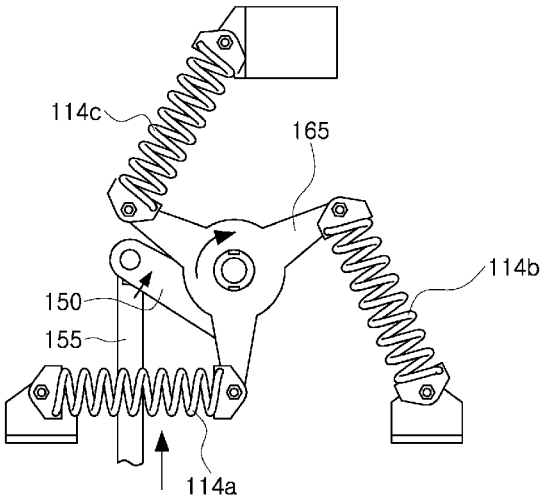
FIG. 18 is a side view illustrating operations of a lever, a link, and a breaking spring when a spring operation device according to an exemplary embodiment in the present disclosure is broken.

FIG. 17 illustrates an operational state of the power transmission unit when a breaking operation is performed, and FIG. 18 illustrates operations of the lever 150, the link 155, and the breaking spring 114 when a breaking operation is performed.

First, in order for the circuit breaker to perform a breaking operation, it is based upon the premise that the circuit breaker is closed.

When the circuit breaker is closed, the breaking actuating plate 220 is in a state of having been rotated in a counterclockwise direction as illustrated in FIG. 15. Here, as mentioned above, the first breaking spring 114*a*, the second breaking spring 114*b*, and the third breaking spring 114*c* are charged by the breaking shaft 102 which has been rotated in a counterclockwise direction when the closing operation is performed.

Also, the charged first breaking spring 114*a*, the second breaking spring 114*b*, and the third breaking spring 114*c* apply elastic restoring force to the breaking shaft 102 and the breaking actuating plate 220 in a clockwise direction. However, rotation of the breaking actuating plate 220 in the clockwise direction is restrained by the breaking latch 270.

Here, as illustrated in FIG. 17, when a fault current occurs in the system so the breaking latch 270 is operated in the clockwise direction, the breaking latch 270 releases the rotational restraint of the breaking actuating plate 220, and thus, the breaking actuating plate 220 and the breaking shaft 102 are rotated in the clockwise direction due to the elastic restoring force from the first breaking spring 114*a*, the second breaking spring 114*b*, and the third breaking spring 114*c*.

When the breaking actuating plate 220 and the breaking shaft 102 are rotated in the clockwise direction, the lever 150 is rotated in the clockwise direction according to rotation of the breaking shaft 102, and the link 155 connected to the lever 150 is moved in a direction in which the movable contactor is drawn out, as illustrated in FIG. 18.

Meanwhile, even in a state in which the closing actuating plate 210 is rotated in the counterclockwise direction as illustrated in FIG. 17, the clutch bar 235 is disposed in the second position by the release cam 239 and maintained in a state of being separated from the clutch frame 231. Thus, when the closing operation is performed, the breaking actuating plate 220 may be rotated in the clockwise direction independently of the closing actuating plate 210.

In the spring operation device 10 according to an exemplary embodiment as described above, since the plurality of small springs 112 and 114 able to store low capacity energy are used, manufacturing costs of the device may be reduced.

Also, in the spring operation device 10 according to an exemplary embodiment as described above, since the plurality of springs 112 and 114 are disposed to have a delta structure, output characteristics of the plurality of springs 112 and 114 may become uniform and reduced in design.

Also, in the spring operation device 10 according to an exemplary embodiment as described above, since the closing shaft 101 and the breaking shaft 102 have a coaxial structure and are configured to interwork with each other through the clutch unit 230, the device is reduced in size.

As set forth above, according to exemplary embodiments of the present disclosure, since a plurality of low capacity small springs are disposed such that output characteristics thereof are uniform, the device may be reduced in size and cost may be reduced.

While exemplary embodiments have been shown and described above, it will be apparent to those skilled in the art that modifications and variations could be made without departing from the scope of the present invention as defined by the appended claims.

What is claimed is:

1. A spring operation device comprising:

a closing shaft rotating to apply closing driving force to a movable contactor of a circuit breaker; a breaking shaft connected to the closing shaft in an axial direction and rotating to apply breaking driving force to the movable contactor of the circuit breaker;

a plurality of springs having one ends connected to the closing shaft and the breaking shaft and the other ends fixed in position and provided along circumferences of the closing shaft and the breaking shaft in order to transmit elastic restoring force to the closing shaft and the breaking shaft to rotate the closing shaft and the breaking shaft; and a power transmission unit provided in a location in which the closing shaft and the breaking shaft are connected, connecting the closing shaft and the breaking shaft when a closing operation is performed, and releasing a connection between the closing shaft and the breaking shaft when a breaking operation is performed, wherein the plurality of springs are provided to have a rotationally symmetrical structure with respect to rotational axes of the closing shaft and the breaking shaft and cooperate with each other to rotate the closing shaft and the breaking shaft in a single direction, and wherein the closing shaft and the breaking shaft are coaxial and independently rotatable, and the plurality of springs include a plurality of closing springs connected to the closing shaft and a plurality of breaking springs connected to the breaking shaft.

2. The spring operation device of claim 1, wherein the plurality of springs are provided in three directions along the circumferences of the closing shaft and the breaking shaft, centered on the closing shaft and the breaking shaft, to form a delta structure.

3. The spring operation device of claim 2, wherein the plurality of springs are disposed in such a manner that lines extending therefrom form an equilateral triangular delta structure centered on the closing shaft and the breaking shaft.

4. The spring operation device of claim 2, wherein each of the plurality springs provided along the circumferences of the closing shaft and the breaking shaft is configured as one of a pair of springs.

5. The spring operation device of claim 1, wherein each of the plurality of springs is a tension spring.

6. The spring operation device of claim 1, wherein each of the plurality of springs is a cold wound coil spring.

7. The spring operation device of claim 1, wherein when the closing spring is charged, the power transmission unit releases a connection between the closing shaft and the breaking shaft.

8. The spring operation device of claim 7, wherein the power transmission unit includes:

a closing actuating plate coupled to the closing shaft in such a manner that rotational behavior thereof is the same as that of the closing shaft;

a breaking actuating plate coupled to the breaking shaft such that rotational behavior thereof is the same as that of the breaking shaft, receiving rotational force from the closing actuating plate when a closing operation is performed, and rotated independently of the closing actuating plate when a breaking operation is performed and when the closing spring is charged; and a clutch unit provided on the closing actuating plate and the breaking actuating plate, and transmitting rotational force from the closing actuating plate to the breaking actuating plate when a closing operation is performed.

9. The spring operation device of claim 8, further comprising a charging cam rotating the closing actuating plate in a direction in which the closing spring is charged.

10. The spring operation device of claim 9, further comprising a driving unit rotating the charging cam.

11. The spring operation device of claim 8, further comprising a closing latch restraining rotation of the closing actuating plate, and releasing the rotational restraint of the closing actuating plate when a closing operation is performed.

12. The spring operation device of claim 8, further comprising a breaking latch restraining rotation of the breaking actuating plate and releasing the rotational restraint of the breaking actuating plate when a breaking operation is performed.

13. The spring operation device of claim 8, wherein the clutch unit includes:

a clutch frame provided on the breaking actuating plate;

a clutch bar provided on the closing actuating plate, moved or rotated to be disposed in a first position or a second position, and fastened to the clutch frame in the first position, and separated from the clutch frame in the second position, wherein the clutch bar is disposed in the first position when the closing actuating plate is rotated at a charging completion rotation angle of the closing spring, and disposed in the second position when the closing actuating plate is rotated at a closing completion rotation angle.

14. The spring operation device of claim 13, further comprising a closing side support plate, to which the closing shaft is rotatably coupled, disposed to face one side of the closing actuating plate.

15. The spring operation device of claim 14, wherein the clutch bar is rotatably provided on both sides of the closing actuating plate and has a clutch roller protruding from one side of the closing actuating plate, and the closing side support plate has a connection cam pressing the clutch roller upwardly to rotate the clutch bar to the first position when the closing actuating plate is rotated at a charging completion rotation angle of the closing spring and a release cam pressing the clutch roller downwardly to rotate the clutch bar to the second position when the closing actuating plate is rotated at a closing completion rotation angle.

16. The spring operation device of claim 1, wherein the plurality of breaking springs are charged through rotational force from the closing shaft and the breaking shaft rotated by elastic restoring force from the plurality of closing springs when a closing operation is performed.

17. The spring operation device of claim 14, further comprising a closing side support plate to which the breaking shaft is rotatably coupled, the power transmission unit is provided between the closing side support plate and the breaking side support plate, the plurality of closing springs are disposed on an outer side of the closing side support plate, and the plurality of breaking springs are disposed on an outer side of the breaking side support plate.

18. The spring operation device of claim 1, further comprising an elasticity transmission member coupled to the closing shaft in such a manner that rotational behavior thereof is the same as that of the closing shaft, and extending in a radial direction of the closing shaft, the plurality of springs being connected to an outer portion of the elasticity transmission member.

* * * * *